US010784655B2

(12) United States Patent
Subramanian

(10) Patent No.: US 10,784,655 B2
(45) Date of Patent: Sep. 22, 2020

(54) CORONA IGNITER WITH HERMETIC COMBUSTION SEAL ON INSULATOR INNER DIAMETER

(71) Applicant: TENNECO INC., Lake Forest, IL (US)

(72) Inventor: Balakrishnan Subramanian, Portland, OR (US)

(73) Assignee: Tenneco Inc., Lake Forest, IL (US)

( * ) Notice: Subject to any disclaimer, the term of this patent is extended or adjusted under 35 U.S.C. 154(b) by 0 days.

(21) Appl. No.: 16/278,988

(22) Filed: Feb. 19, 2019

(65) Prior Publication Data

US 2019/0181621 A1 Jun. 13, 2019

Related U.S. Application Data

(62) Division of application No. 15/409,694, filed on Jan. 19, 2017, now Pat. No. 10,211,605.

(60) Provisional application No. 62/281,856, filed on Jan. 22, 2016.

(51) Int. Cl.

| | |
|---|---|
| ***H01T 13/36*** | (2006.01) |
| ***H01T 13/34*** | (2006.01) |
| ***H01T 13/50*** | (2006.01) |
| ***H01T 13/08*** | (2006.01) |
| ***H01T 21/02*** | (2006.01) |

(52) U.S. Cl.

CPC ..... *H01T 13/36* (2013.01); *H01T 13/08* (2013.01); *H01T 13/34* (2013.01); *H01T 13/50* (2013.01); *H01T 21/02* (2013.01)

(58) Field of Classification Search

CPC ..... H01T 13/36; H01T 13/50; H01T 13/34; H01T 13/08; H01T 21/02

See application file for complete search history.

(56) References Cited

U.S. PATENT DOCUMENTS

| | | | | |
|---|---|---|---|---|
| 2,939,983 | A * | 6/1960 | Pierce | H01T 13/52 313/131 R |
| 7,843,117 | B2 ‡ | 11/2010 | Jaffrezic | H01T 13/34 313/14 |
| 8,278,808 | B2 ‡ | 10/2012 | Lykowski | H01T 13/38 313/14 |

(Continued)

OTHER PUBLICATIONS

International Search Report, dated Apr. 18, 2017 (PCT/US2017/014207).‡

*Primary Examiner* — Kevin Quarterman

(74) *Attorney, Agent, or Firm* — Robert L. Stearns; Dickinson Wright, PLLC

(57) ABSTRACT

A corona igniter including a hermetic combustion seal between an insulator and center electrode is provided. The combustion seal includes a metallic coating, such as a nickel-based layer applied to a layer of molybdenum-manganese, and the metallic coating is disposed on the insulator inner surface. Optionally, a shot of copper-based powder can be disposed on a head of the center electrode. The center electrode and/or the copper-based powder is then brazed to the metallic coating on the inner surface of the insulator. The process can include applying the metallic coating to the inner surface while applying a metal coating to an outer surface of the insulator. The method further includes brazing the center electrode and/or the copper-based powder to the metallic coating on the inner surface while brazing the metal coating on the outer surface to a metal shell.

7 Claims, 6 Drawing Sheets

(56) References Cited

U.S. PATENT DOCUMENTS

| | | | | |
|---|---|---|---|---|
| 8,853,930 | B2 ‡ | 10/2014 | Yamada | H01T 13/36 313/14 |
| 9,035,562 | B2 ‡ | 5/2015 | Katsuraya | H01T 13/20 315/20 |
| 9,065,256 | B2 ‡ | 6/2015 | Makarov | H01T 13/50 |
| 2007/0188064 | A1 ‡ | 8/2007 | Lykowski | H01T 13/20 313/14 |
| 2008/0018216 | A1 * | 1/2008 | Camilli | F02P 3/08 313/141 |
| 2010/0052500 | A1 * | 3/2010 | Walker, Jr. | H01T 13/34 313/145 |
| 2011/0253089 | A1 ‡ | 10/2011 | Braeuchle | H01T 13/50 123/14 |
| 2013/0065474 | A1 ‡ | 3/2013 | Lykowski | H01T 13/38 445/7 |
| 2015/0037738 | A1 ‡ | 2/2015 | McAlister | F02M 57/06 431/6 |

* cited by examiner
‡ imported from a related application

CORONA IGNITER WITH HERMETIC COMBUSTION SEAL ON INSULATOR INNER DIAMETER

CROSS-REFERENCE TO RELATED APPLICATION

This U.S. Divisional patent application claims the benefit of U.S. Utility patent application Ser. No. 15/409,694, filed Jan. 19, 2017, now U.S. Pat. No. 10,211,605, issued Feb. 19, 2019, which claims the benefit of U.S. provisional patent application No. 62/281,856, filed Jan. 22, 2016, the entire contents of both which are incorporated herein by reference.

BACKGROUND OF THE INVENTION

1. Field of the Invention

This invention relates generally to corona igniters with combustion seals, and methods of manufacturing corona igniters with combustion seals.

2. Related Art

Glass seals are oftentimes used to bond an electrically conductive component, such as center electrode, and an insulator of an ignition device, for example a corona igniter. The glass seal of the corona igniter is typically formed by disposing a glass powder in a bore of the insulator, and then subsequently firing the insulator, center electrode, and glass powder together in a furnace. The heat causes certain components of the glass seal to expand and thus form the bond between the insulator and center electrode. Another option is to use a brass seal between the center electrode and the inner surface of the insulator. However, manufacturers are continuously trying to improve the quality and reliability of the bond, and thus always achieve a hermetic combustion seal along the inner surface of the insulator, while also keeping production time and costs to a minimum.

SUMMARY OF THE INVENTION

One aspect of the invention provides a corona igniter comprising an insulator and a center electrode. The insulator includes an inner surface surrounding a bore and extending from an upper connection end to an insulator nose end. The inner surface of the insulator includes an electrode seat between the upper connection end and the insulator nose end. The inner surface of the insulator also presents an inner diameter, and the inner diameter decreases along the electrode seat in a direction moving toward the insulator nose end. The center electrode is disposed in the bore of the insulator. The center electrode includes a head disposed on the electrode seat of the inner surface of the insulator. A metallic coating is disposed on the inner surface of the insulator between the electrode seat and the upper connection end, and the metallic coating not disposed on the inner surface of the insulator below the electrode seat. A braze is disposed along the inner surface of the insulator between the electrode seat and the upper connection end.

Another embodiment of the invention provides a corona igniter comprising an insulator including an inner surface surrounding a bore. A metallic coating is disposed on the inner surface of the insulator, a center electrode is disposed in the bore of the insulator, and a braze is disposed between the center electrode and the metallic coating.

Another aspect of the invention provides a method of manufacturing a corona igniter. The method comprises providing an insulator including an inner surface surrounding a bore and extending from an upper connection end to an insulator nose end, the inner surface of the insulator including an electrode seat between the upper connection end and the insulator nose end, the inner surface of the insulator presenting an inner diameter, and the inner diameter decreasing along the electrode seat in a direction moving toward the insulator nose end. The method also includes disposing a metallic coating on the inner surface of the insulator between the electrode seat and the upper connection end and not below the electrode seat; and disposing a center electrode in the bore of the insulator, the center electrode including a head. The step of disposing the center electrode in the bore of the insulator includes disposing the head of the center electrode on the electrode seat of the insulator. The method further includes brazing the metallic coating on the inner surface of the insulator between the electrode seat and the upper connection end.

Another embodiment of the invention provides a method for manufacturing a corona igniter comprising the steps of: providing an insulator including an inner surface surrounding a bore; disposing a metallic coating on the inner surface of the insulator; disposing a center electrode in the bore of the insulator; and brazing the center electrode to the metallic coating.

The combination of the metallic coating and braze provides an economical and reliable hermetic combustion seal between the center electrode and the inner surface of the insulator. The metallic coating can be applied to the inner surface of the insulator at the same time that a metal coating is applied to an outer surface of the insulator. In addition, the brazing step can be performed while brazing the metal coating on the outer surface of the insulator to a metal shell. Since processes currently used to manufacture corona igniters already include the steps of applying the metal coating to the outer surface of the insulator and brazing the metal coating on the outer surface of the insulator to the shell, no additional process time is typically required to implement the steps of the present invention. In addition, the corona igniter will not require a Kovar wire on the center electrode, thereby eliminating the cost of welding the Kovar to the center electrode. The metallic coating on the inner surface of the insulator also eliminates the need for a glass material, and helps provide electrical continuity within the insulator, thus eliminating the need for brass powder.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF EXEMPLARY EMBODIMENTS

Figure 1:
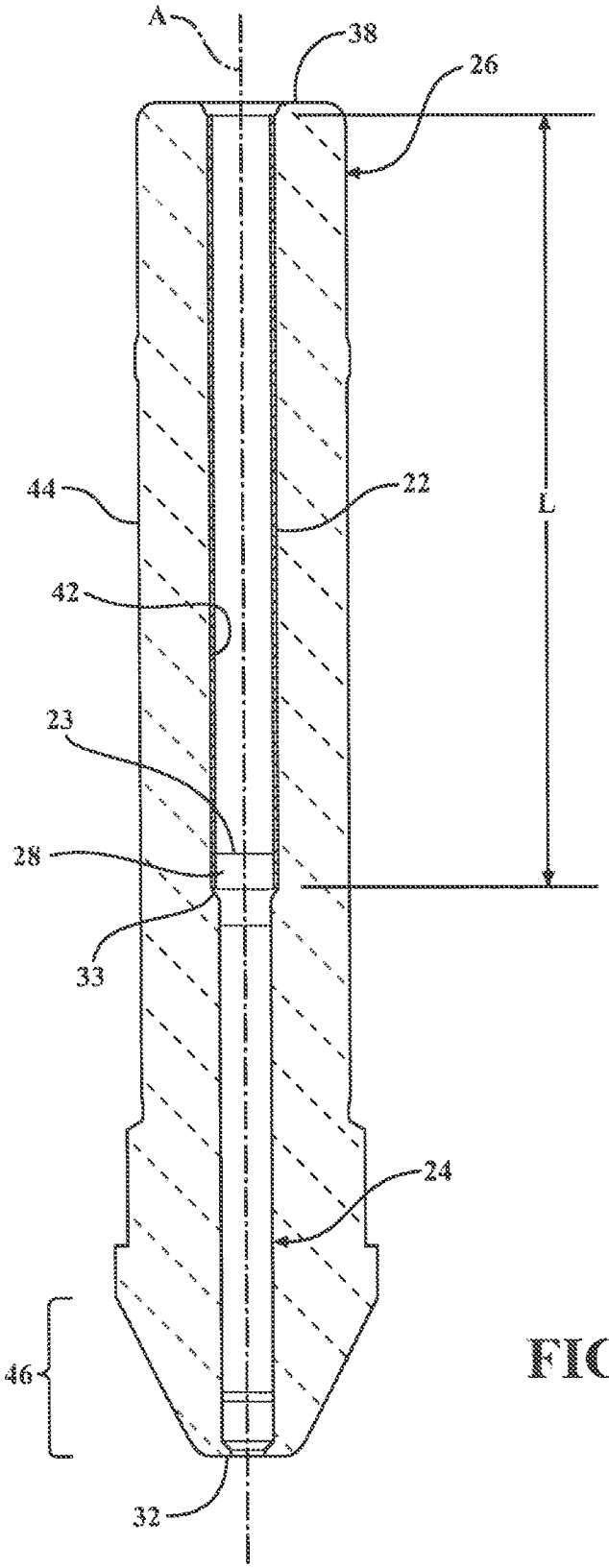
FIG. 1 is a cross-sectional view of an insulator and center electrode of a corona igniter according to one example embodiment including a metallic coating and braze providing a hermetic combustion seal between the center electrode and inner surface of the insulator.

One aspect of the invention includes a corona igniter 20 for an internal combustion engine including a metallic coating 22 and braze 23 providing a hermetic combustion seal between a center electrode 24 and insulator 26 to prevent gases located in a combustion chamber of the engine from entering the igniter 20. FIGS. 1, 2, and 4-6 are examples of the center electrode 24 and insulator 26 with the hermetic combustion seal therebetween, and FIG. 3 is an example of a corona igniter 20 including the combustion seal.

The corona igniter 20 including the hermetic combustion seal can have various different designs, including, but not limited to the designs shown in the Figures. In the example embodiments of FIGS. 1-3, the center electrode 24 is disposed in the bore of the insulator 26, and the center electrode 24 extends along a center axis A from a head 28 to a firing end 32. The center electrode 24 is formed of an electrically conductive material, such as nickel or a nickel alloy. In the example embodiment of FIGS. 1-3, the head 28 of the center electrode 24 is supported and maintained in a predetermined axial position by a reduced diameter of the insulator 26, referred to as an electrode seat 33, and an electrical terminal 30 rests on the head 28 of the center electrode 24. A majority of the length of the center electrode 24 is surrounded by the insulator 26. Also in this example embodiment, the center electrode 24 includes a firing tip 34 at the firing end 32. The firing tip 34 has a plurality of branches each extending radially outwardly from the center axis A for emitting an electric field and providing the corona discharge during use of the corona igniter 20 in the internal combustion engine.

Figure 2:
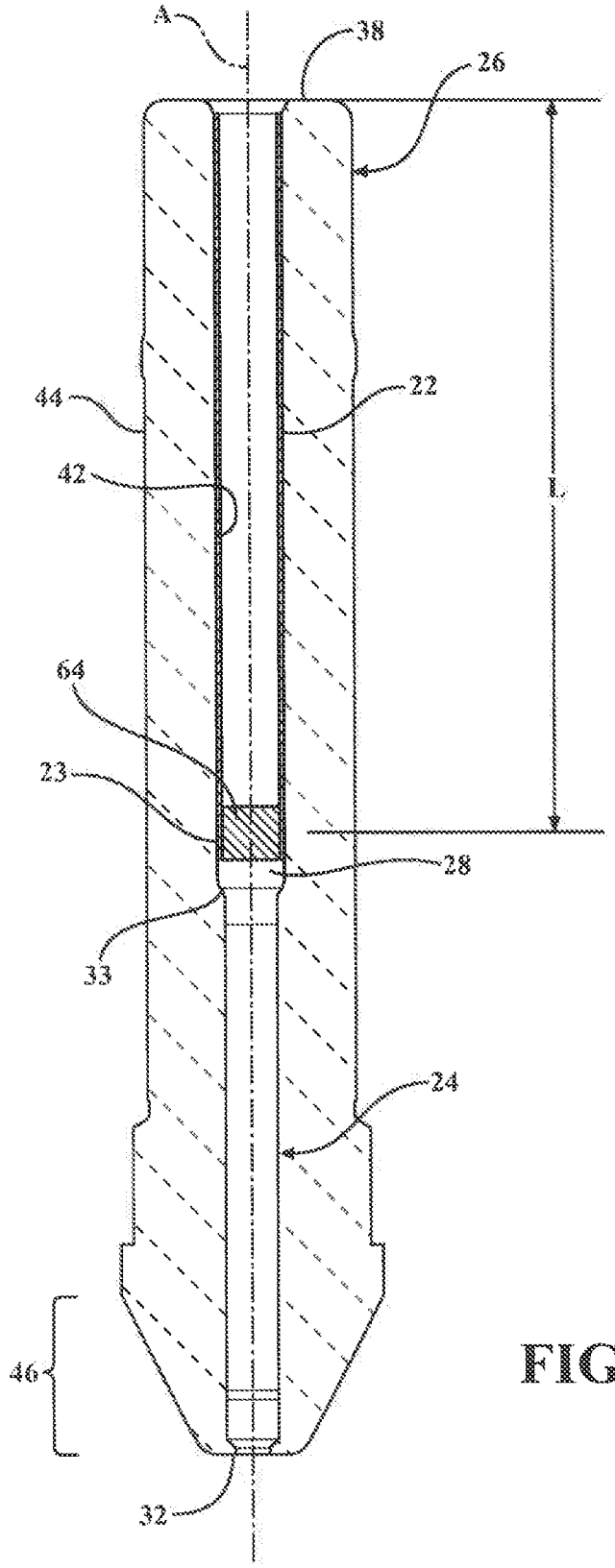
FIG. 2 a cross-sectional view of an insulator and center electrode of a corona igniter of another example embodiment including a metallic coating and copper-based powder brazed to the inner surface of the insulator to provide a hermetic combustion seal between the center electrode and the insulator.
Figure 3:
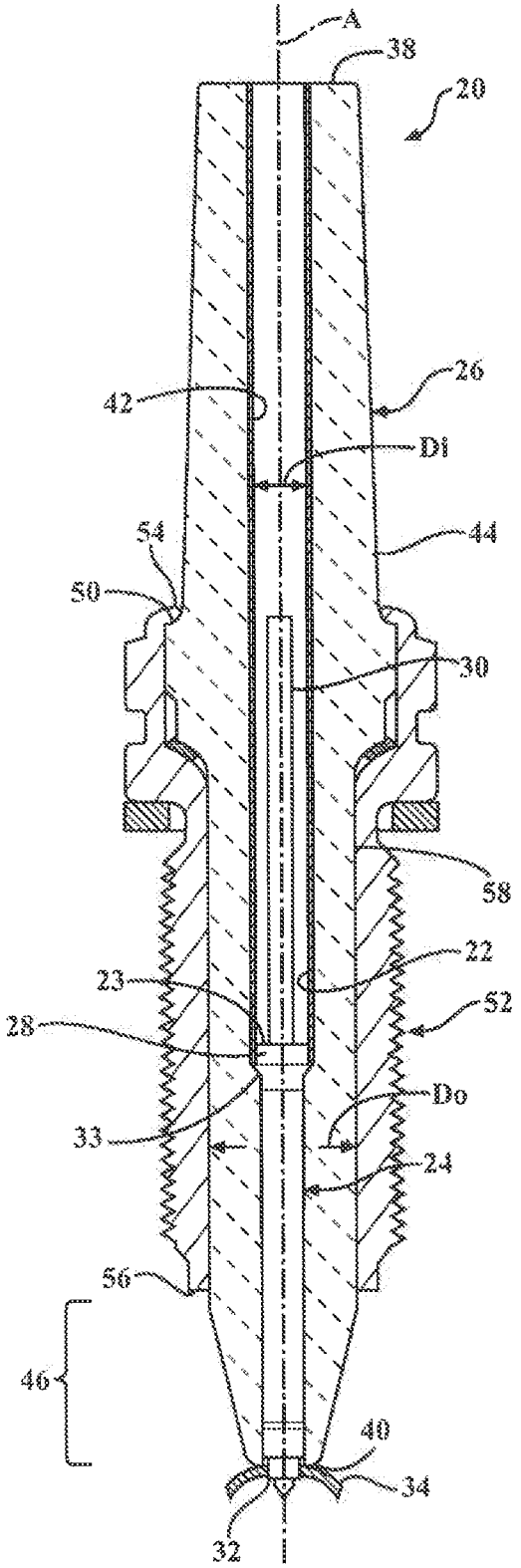
FIG. 3 is a cross-sectional view of a corona igniter according to another example embodiment including a metallic coating and braze providing a hermetic combustion seal between the center electrode and insulator.

The insulator 26 of FIG. 3 extends longitudinally along the center axis A from an upper connection end 38 to an insulator nose end 40. The insulator 26 is formed of an insulating material, typically a ceramic such as such as alumina. The insulator 26 also presents an inner surface 42 surrounding the bore which extends longitudinally from the upper connection end 38 to the insulator nose end 40 for receiving the center electrode 24 and possibly other electrically conductive components. The firing tip 34 of the center electrode 24 is typically disposed longitudinally past the insulator nose end 40. As mentioned above, in the embodiment of FIGS. 1-3, the insulator inner surface 42 presents an inner diameter Di which decreases along a portion of the insulator 26 moving toward the insulator nose end 40 to form the electrode seat 33 which supports the electrode head 28. The inner diameter Di extends across and perpendicular to the center axis A. The insulator inner diameter Di decreases from a top of the electrode seat 33 to a base of the electrode seat 33, which is in the direction moving toward the insulator nose end 40.

The insulator 26 of the example embodiment also presents an insulator outer surface 44 having an insulator outer diameter $D_o$ extending across and perpendicular to the center axis A. The insulator outer surface 44 extends longitudinally from the upper connection end 38 to the insulator nose end 40. In the exemplary embodiments, the insulator outer diameter $D_o$ decreases along a portion of the insulator 26 moving toward the insulator nose end 40 to present an insulator nose region 46. The insulator outer diameter $D_o$ can also vary along other portions of the length, as shown in the Figures.

The corona igniter 20 also includes a shell 52 formed of metal and surrounding a portion of the insulator 26. The shell 52 is typically used to couple the insulator 26 to a cylinder block (not shown) of the internal combustion engine. The shell 52 extends along the center axis A from a shell upper end 54 to a shell lower end 56. The shell upper end 54 is disposed between an insulator upper shoulder 50 and the insulator upper end 38 and engages the insulator 26. The shell lower end 56 is disposed adjacent the insulator nose region 46 such that at least a portion of the insulator nose region 46 extends axially outwardly of the shell lower end 56.

As mentioned above, the hermetic combustion seal between the insulator 26 and center electrode 24 is provided by applying the metallic coating 22 to the inner surface 42 of the insulator 26, and then brazing. In the example embodiments of FIGS. 1-3, the metallic coating 22 is located between the electrode seat 33 and the upper connection end 38. The metallic coating 22 can be formed of various different compositions. According to one embodiment, the metallic coating 22 includes a layer of molybdenum and manganese. For example, the metallic coating 22 can consist of molybdenum and manganese. However, the layer of molybdenum and manganese could include trace amounts of other elements or components. The layer of molybdenum and manganese typically includes an oxide when applied, but the oxide is not present after heating in a furnace. According to another embodiment, the metallic coating 22 is a nickel-based layer, such as electroless nickel plating. For example, the metallic coating 22 can consist of nickel. However, the nickel-based layer can include trace amounts of other elements or components. The nickel-based layer is typically referred to as a nickel overlay, and can be applied by an electroplating process, an electrolytic process, an electroless process, or by a chemical reaction. The nickel-based layer is typically applied as a nickel oxide material, but the oxide is not present after heating in a furnace. Preferably, the metallic coating 22 includes the nickel-based layer applied to the layer of molybdenum and manganese.

In the embodiments of FIGS. 1-3, the metallic coating 22 is applied along only a portion of the insulator inner surface 42 for example in a region extending from the electrode seat 33, or slightly above the electrode seat 33, to the upper connection end 38, or around the upper connection end 38. In these embodiments, the metallic coating 22 is not located below the electrode seat 33 which supports the electrode head 28, and the inner surface 42 of the insulator 26 is not coated in the region extending from the base of the electrode seat 33 to the insulator nose end 40. The length L1 of the metallic coating 23 of the example embodiments is identified in FIGS. 1 and 2. The thickness of the metallic coating 22 can vary, but it is typically less than 0.1 mm.

The hermetic combustion seal further includes the braze 23 disposed along the insulator inner surface 42 between the center electrode 24 and the insulator inner surface 42. In the embodiments of FIGS. 1-3, the braze is between the electrode seat 33 and the upper connection end 38. In the example of FIG. 1, the head 28 of the center electrode 24 is brazed directly to the metallic coating 22 on the insulator inner surface 42. In this case, the braze 23 is located along the head 28 of the center electrode 24 but not along other portions of the insulator inner surface 42. In the example of FIG. 2, a shot of copper-based powder 64 is disposed along the center axis A on the head 28 of the center electrode, and the copper-based powder 64 is then brazed to the metallic coating 22 on the inner surface 42 of the insulator 26. The copper-based powder 64 can consist of copper or a copper alloy. In this case, the braze 23 is located along the copper-based powder 64 but not along other portions of the insulator inner surface 42. Due to the combination of the metallic coating 22 and the braze 23, the corona igniter 20 does not require a Kovar wire on the center electrode 24, thereby eliminating the cost of welding the Kovar to the center electrode 24. In addition to a reliable combustion seal, the metallic coating 22 and braze 23 helps provide electrical continuity within the insulator 26, thus eliminating the need for glass material or brass powder.

Figure 4:
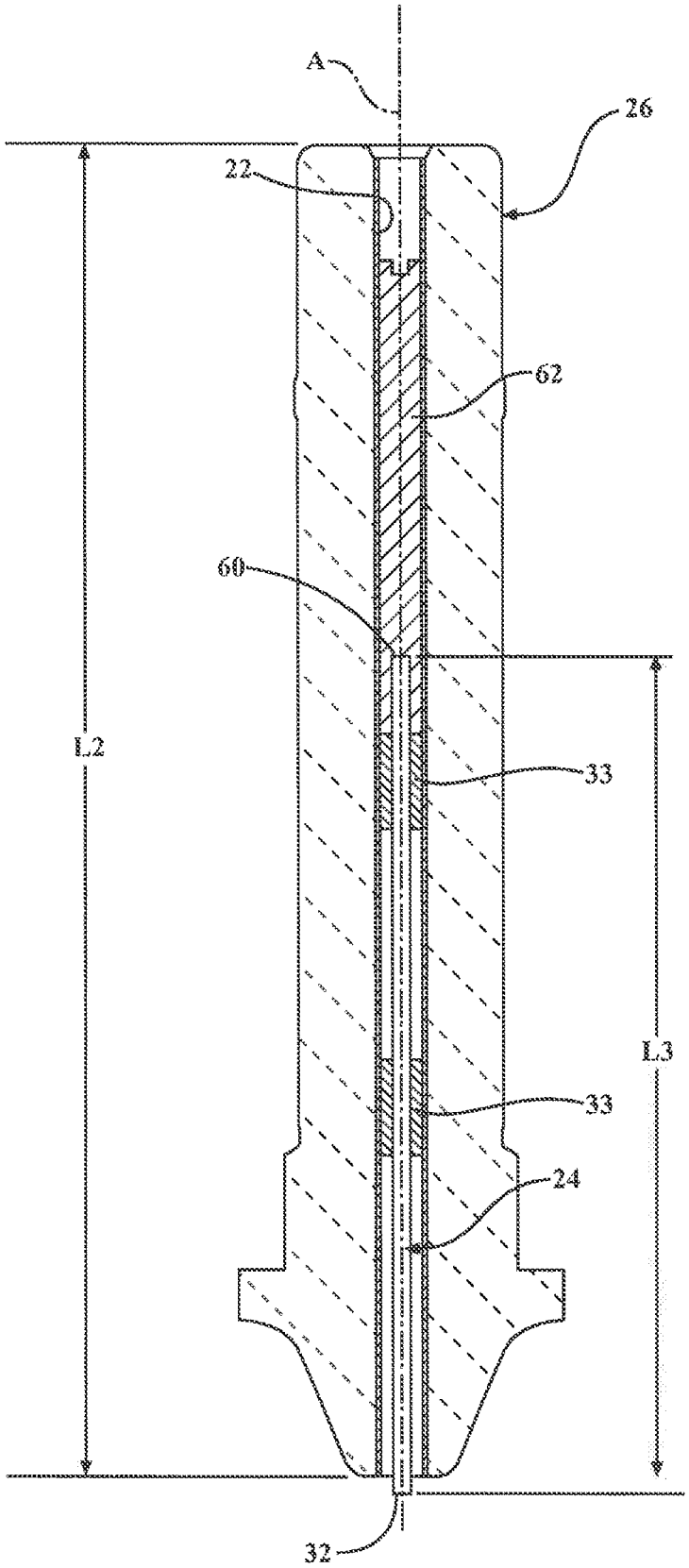
FIG. 4 is a cross-sectional view of an insulator and center electrode of a corona igniter of another example embodiment including a braze between the center electrode and metallic coating.
Figure 5:
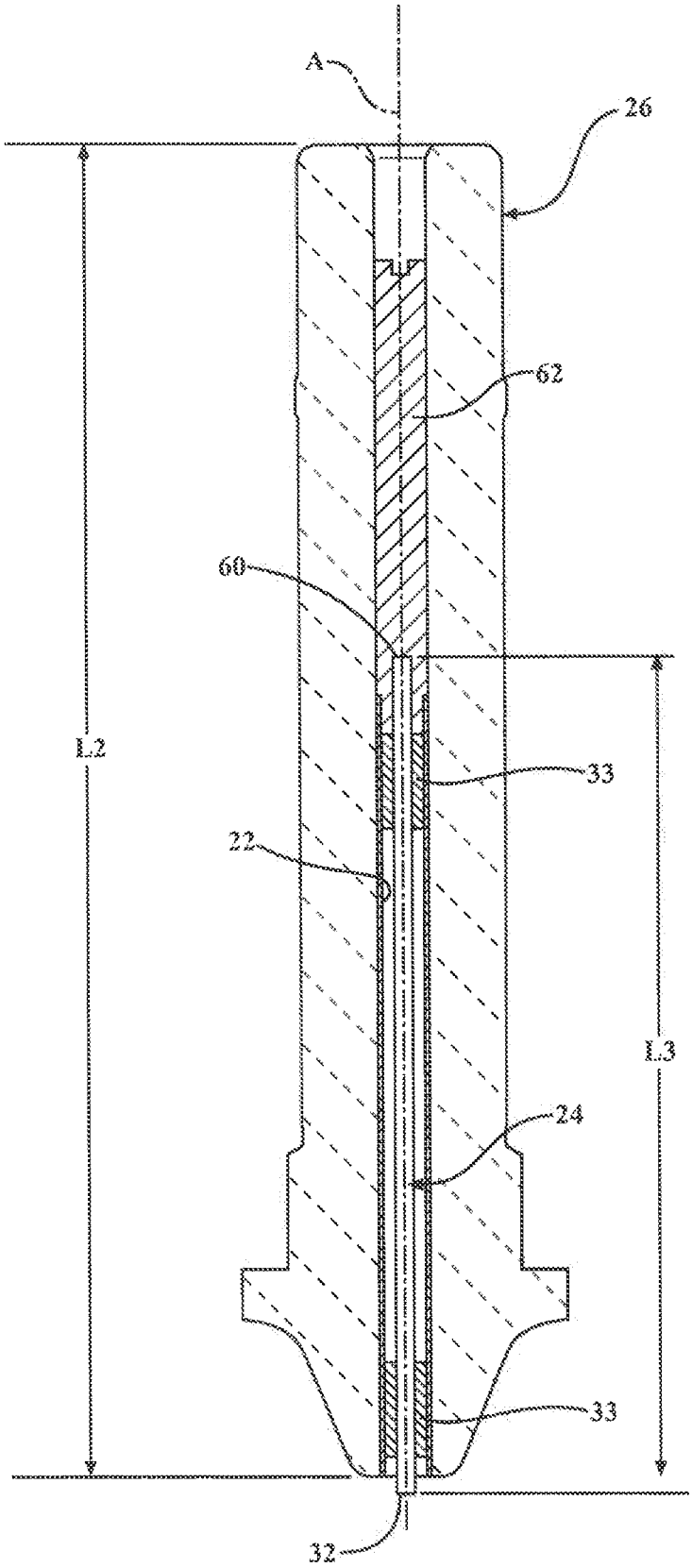
FIG. 5 is a cross-sectional view of an insulator and center electrode of a corona igniter of another example embodiment including a braze between the center electrode and a metallic coating.
Figure 6:
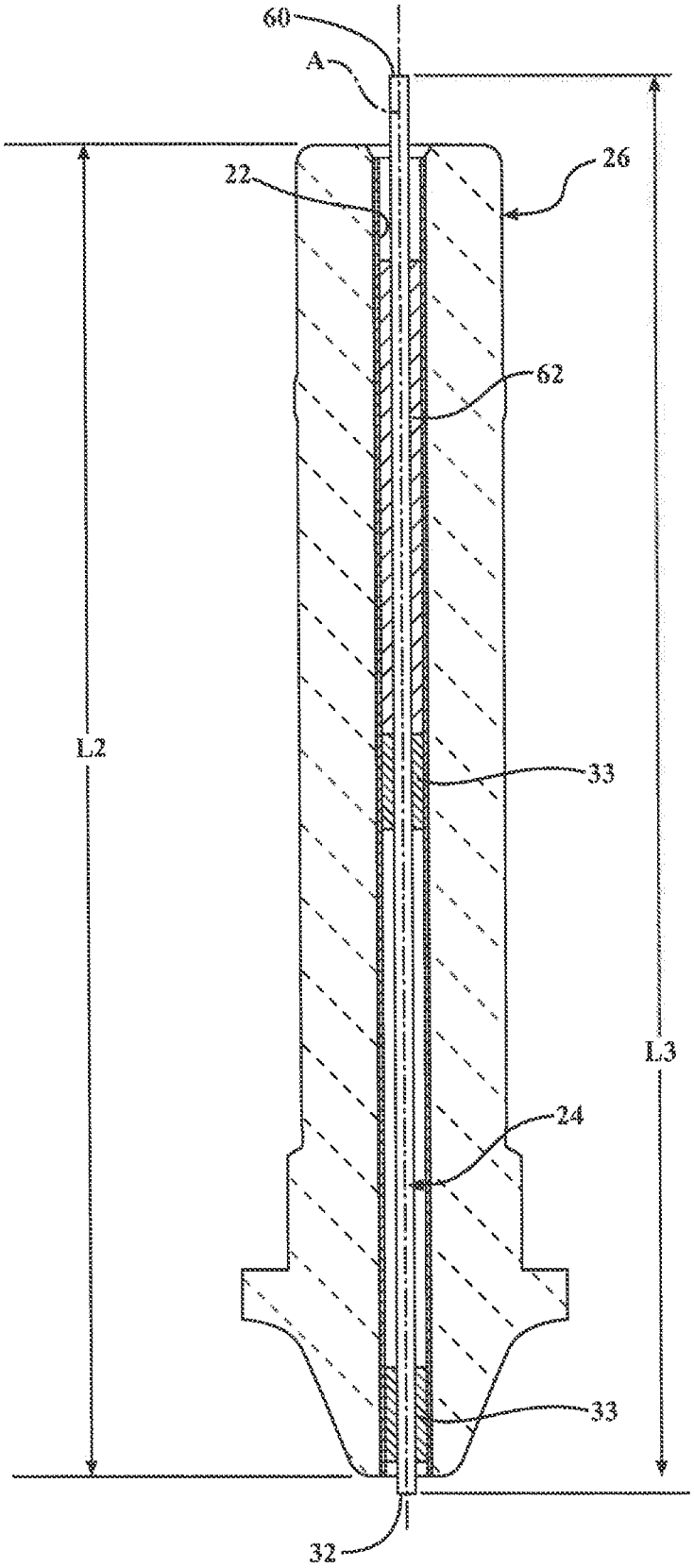
FIG. 6 is a cross-sectional view of an insulator and center electrode of a corona igniter of another example embodiment including a braze between the center electrode and a metallic coating.

Other example embodiments of the insulator 26 and center electrode 24 of the corona igniter 20 are shown in FIGS. 4-6. According to this embodiment, the insulator 26 includes the inner surface 42 surrounding the bore, the metallic coating 22 disposed on the inner surface 42, the center electrode 24 disposed in the bore of the insulator 26, and the braze 23 disposed between the center electrode 24 and the metallic coating 22. However, in this case, the center electrode 24 does not include the head 28, and the inner surface 42 of the insulator 26 does not include the electrode seat 33 to support the center electrode 24, as in the embodiments of FIGS. 1-3. Rather, in the embodiments of FIGS. 4-6, the inner surface 42 of the insulator 26 extends straight from the upper connection end 38 to the insulator nose end 40, such that the diameter of the bore is constant, and the braze 23 secures the center electrode 24 to the metallic coating 22 on the inner surface 42.

In the embodiments of FIGS. 4-6, the metallic coating 22 can include the layer of molybdenum and manganese and/or the nickel-based layer, as described above. According to these example embodiments, the inner surface 42 of the insulator 26 has a length L2 extending from the upper connection end 38 to the insulator nose end 40, and the metallic coating 22 is located along at least 50% of the length of the inner surface 42. In the embodiment of FIG. 5, the metallic coating 22 is located on greater than 50%, but less than 100% of the length L2 of the inner surface 42. In the embodiments of FIGS. 4 and 6, the metallic coating 22 extends continuously from the upper connection end 38 to the insulator nose end 40.

Also in the embodiments of FIGS. 4-6, the braze 23 can be located in one or more various locations along the center electrode 24, and not necessarily at the top of the center electrode 24, as in the embodiments of FIGS. 1-3. Typically, the braze 23 is located along less than 50% of said length L2 of the inner surface 42 of the insulator 26. In the embodiments of FIGS. 4-6, the braze 23 located in a single distinct location along the inner surface 42 of the insulator 26, between the center electrode 24 and the metallic coating 22. FIGS. 4-6 show examples of where the braze 23 may be located, but the braze 23 is typically only in one location along the inner surface 42 of the insulator 26.

Also in the embodiments of FIGS. 4-6, the center electrode 22 presents a length L3 extending from a top end 60 to the firing end 32, and the length L3 of the center electrode 22 can vary. As shown in FIGS. 4 and 5, the length L3 of the center electrode 24 is less than the length L2 of the insulator inner surface 42. Alternatively, the length L3 of the center electrode 22 could equal the length L2 of the insulator inner surface 42. In the embodiment of FIG. 6, the length L3 of the center electrode 22 is greater than the length L2 of the insulator inner surface 42. Also in the embodiments of FIGS. 4-6, brass powder 62 is located along an uppermost portion of the center electrode 22 and fills a portion of the insulator bore.

According to the example embodiments, in addition to applying the metallic coating 20 to the inner surface 42 of the insulator 26, an outer metal coating 58 is applied to the outer surface 44 of the insulator 26. Typically, the outer metal coating 58 is in contact with the metal shell 52, but could be applied to other areas which do not contact the metal shell 52. Preferably, a nickel-based layer is also applied to the inner surface 42 of the metal shell 52. The outer metal coating 58 is then brazed to the inner surface 42 of the shell 52, or the nickel-based layer on the inner surface 42 of the metal shell 52, to provide another hermetic combustion seal between the insulator 26 and shell 52 to prevent gases from the combustion chamber from entering the corona igniter 20. The outer metal coating 58 applied to the outer surface 44 and the metallic coating 22 applied to the inner surface 42 can have the same composition or a different composition. Preferably, the coatings 22, 58 are applied to the inner and outer surfaces 42, 44 of the insulator 26 during the same process step to reduce time and costs. The step of brazing the electrode head 28 to the inner surface 42 of the insulator 26 and the step of brazing the outer surface 44 of the insulator 26 to the shell 52 can also be conducted during the same process step to further reduce time and costs. In addition, limiting the number of firing steps is expected to improve the quality of the seals.

Another aspect of the invention provides a method of manufacturing the corona igniter 20 with the hermetic combustion seal. To manufacture the corona igniter 20 of FIGS. 1-3, the method includes applying the metallic coating 22 to the inner surface 42 of the insulator 26 in the region extending from or around the electrode seat 33 to our around the upper connection end 38 while applying the outer metal coating 58 to the outer surface 42 of the insulator 26. In these embodiments, the method does not include applying the metallic coating 22 below the electrode head 28. The method of these embodiments then includes disposing the center electrode 24 in the bore of the insulator 26 such that the head 28 of the center electrode 24 rests on the electrode seat 33.

Once the center electrode 24 is disposed in the insulator 26, the method further includes a brazing step along the inner surface 42 of the insulator 26. For example, the method can include brazing head 28 of the center electrode 24 and/or the shot of copper-based powder 64 to the inner surface 42 of the insulator 26. Preferably, this step is conducted simultaneously with the step of brazing the outer metal coating 58 on the outer surface 44 of the insulator 26 to the metal shell 52. During this step, one hermetic combustion seal is formed between the inner surface 42 of the insulator 26 and the center electrode 24, and another hermetic combustion seal is formed between the outer surface 44 of the insulator 26 and the metal shell 52 to prevent combustion gases from entering the igniter 20. Since processes currently used to manufacture corona igniters already include the step of applying the outer metal coating 58 to the outer surface of the insulator 26 and brazing the outer surface 42 of the insulator 26 to the shell 52, no additional process time is be required to implement the steps of the present invention. Accordingly, the reliable hermetic combustion seal is obtained without a significant increase in process time or costs.

Another aspect of the invention provides a method of manufacturing the corona igniter 20 including the insulator 26 and center electrode 24 of FIGS. 4-6. In this case, the method includes providing the insulator 26 including the inner surface 42 surrounding the bore; disposing the metallic coating 22 on the inner surface 42 of the insulator 26; disposing the center electrode 24 in the bore of the insulator 26; and brazing the center electrode 24 to the metallic coating 22. According to these embodiments, the inner surface 42 of the insulator 26 extends straight from upper connection end 38 to the insulator nose end 40, the inner surface 42 does not include the electrode seat 33, and the center electrode 24 does not include the head 28. According to these embodiments, the braze 23 secures the center electrode 24 to the metallic coating 22 on the insulator inner surface 42. The step of brazing the center electrode 24 to the metallic coating 22 can include disposing the braze 23 in a single distinct location along the length L2 of the inner surface 42.

Obviously, many modifications and variations of the present invention are possible in light of the above teachings and may be practiced otherwise than as specifically described while within the scope of the claims.

The invention claimed is:

1. A method of manufacturing a corona igniter, comprising the steps of:

providing an insulator including an inner surface surrounding a bore and extending from an upper connection end to an insulator nose end, the inner surface of the insulator including an electrode seat between the upper connection end and the insulator nose end;

disposing a metallic coating on the inner surface of the insulator between the electrode seat and the upper connection end and not below the electrode seat;

disposing a center electrode in the bore of the insulator, the center electrode including a head;

the step of disposing the center electrode in the bore of the insulator including disposing the head of the center electrode on the electrode seat of the insulator; and brazing the metallic coating on the inner surface of the insulator between the electrode seat and the upper connection end to the head of the center electrode.

2. The method of claim 1, wherein the brazing step includes brazing the head of the center electrode to the metallic coating on the inner surface of the insulator.

3. The method of claim 1 including disposing a copper-based powder along the center axis on the head of the center electrode, and wherein the brazing step includes brazing the copper-based powder to the metallic coating on the inner surface of the insulator.

4. The method of claim 1, wherein the brazing step includes providing a hermetic seal along the inner surface of the insulator between the electrode seat and the upper connection end.

5. The method of claim 1, wherein the insulator includes an outer surface, and further including the steps of: disposing an outer metal coating on the outer surface of the insulator; disposing a shell formed of metal around the insulator; and brazing the outer metal coating to the shell.

6. The method of claim 5, wherein the step of brazing the metallic coating on the inner surface of the insulator between the electrode seat and the upper connection end and the step of brazing the outer metal coating to the shell occur simultaneously.

7. The method of claim 1, wherein the inner surface of the insulator presents an inner diameter, and the inner diameter decreases along the electrode seat in a direction moving toward the insulator nose end.

* * * * *